US010407274B2

(12) United States Patent
Wang et al.

(10) Patent No.: US 10,407,274 B2
(45) Date of Patent: Sep. 10, 2019

(54) SYSTEM AND METHOD FOR PARAMETER ESTIMATION OF HYBRID SINUSOIDAL FM-POLYNOMIAL PHASE SIGNAL

(71) Applicants: Mitsubishi Electric Research Laboratories, Inc., Cambridge, MA (US); Mitsubishi Electric Corporation, Chiyoda-ku, Tokyo (JP)

(72) Inventors: Pu Wang, Cambridge, MA (US); Philip Orlik, Cambrodge, MA (US); Kota Sadamoto, Tokyo (JP); Wataru Tsujita, Tokyo (JP)

(73) Assignees: Mitsubishi Electric Research Laboratories, Inc., Cambridge, MA (US); Mitsubishi Electric Corporation, Tokyo (JP)

( * ) Notice: Subject to any disclaimer, the term of this patent is extended or adjusted under 35 U.S.C. 154(b) by 391 days.

(21) Appl. No.: 15/442,825

(22) Filed: Feb. 27, 2017

(65) Prior Publication Data

US 2018/0162686 A1 Jun. 14, 2018

Related U.S. Application Data

(60) Provisional application No. 62/431,712, filed on Dec. 8, 2016.

(51) Int. Cl.

| | |
|---|---|
| ***B66B 1/34*** | (2006.01) |
| *B66B 5/04* | (2006.01) |
| *B66B 7/04* | (2006.01) |

(52) U.S. Cl.

CPC ..... *B66B 1/3492* (2013.01); *B66B 5/04* (2013.01); *B66B 7/044* (2013.01)

(58) Field of Classification Search

CPC ..... B66B 1/3492; B66B 5/04; B66B 7/044
USPC ..... 187/247, 277, 289, 292, 293, 295, 296, 187/297, 391, 393
See application file for complete search history.

(56) References Cited

U.S. PATENT DOCUMENTS 5,828,014 A * 10/1998 Goto ..... F16F 15/02 187/292
5,866,861 A * 2/1999 Rajamani ..... B66B 7/044 187/292
5,880,416 A * 3/1999 Colby ..... B66B 1/30 187/293

(Continued)

*Primary Examiner* — Anthony J Salata
(74) *Attorney, Agent, or Firm* — Gennadiy Vinokur; James McAleenan; Hironori Tsukamoto

(57) ABSTRACT

Systems and methods for an elevator. The elevator includes an elevator car to move along a first direction. A transmitter for transmitting a signal having a waveform. A receiver for receiving the waveform. A processor having memory is configured to represent the received waveform as a hybrid sinusoidal frequency modulated (FM)-polynomial phase signal (PPS) model. The hybrid sinusoidal FM-PPS model having PPS phase parameters representing a speed of the elevator car along a first direction and a sinusoidal FM phase parameter representing a vibration of the elevator car along a second direction. The processor solves the hybrid sinusoidal FM-PPS model to produce the speed of the elevator car or the vibration of the elevator car or both. A controller controls an operation of the elevator using the speed of the elevator car or the vibration of the elevator car, or both, to assist in an operational management of the elevator.

20 Claims, 13 Drawing Sheets

(56) References Cited

U.S. PATENT DOCUMENTS

| | | | | |
|---|---|---|---|---|
| 5,896,949 | A | 4/1999 | Hamdy et al. | |
| 5,959,266 | A * | 9/1999 | Uchiumi | B66B 1/30 187/292 |
| 6,802,395 | B1 * | 10/2004 | Helstrom | B66B 5/02 187/247 |
| 7,424,934 | B2 * | 9/2008 | Husmann | B66B 7/046 187/292 |
| 7,637,355 | B2 * | 12/2009 | Tyni | B66B 13/143 187/315 |
| 7,971,688 | B2 * | 7/2011 | Perala | B66B 1/3407 187/293 |
| 8,151,943 | B2 * | 4/2012 | de Groot | B66B 1/2458 187/382 |
| 9,242,833 | B2 * | 1/2016 | Hirabayashi | B66B 1/30 |
| 2015/0014098 | A1 * | 1/2015 | Stolzl | B66B 5/0031 187/248 |
| 2015/0259174 | A1 * | 9/2015 | Mustonen | B66B 5/0031 187/393 |
| 2019/0120662 | A1 * | 4/2019 | Wang | G01D 5/305 |

* cited by examiner

SYSTEM AND METHOD FOR PARAMETER ESTIMATION OF HYBRID SINUSOIDAL FM-POLYNOMIAL PHASE SIGNAL

FIELD OF INVENTION

The present disclosure relates generally to elevator systems, and more particularly to estimating one or a combination of speed and vibration of an elevator car for controlling an operation of the elevator system.

BACKGROUND OF INVENTION

There may be some circumstances when there is a need to measure the speed of an elevator car moving through a hoistway. For example, some needs may be during elevator installation or maintenance. Conventionally, an elevator technician or mechanic climbs on top of the cab and utilizes a hand-held tachometer to check the speed of the elevator during adjustment or testing. This technique typically requires the technician to hold the tachometer against one of the guide rails within the hoistway while simultaneously attempting to run the elevator using the top of car inspection box. While this technique does provide speed information, there are limitations.

Some limitations can include efficiency and accuracy of the speed measurement are sometimes compromised because of the technician's capabilities for maintaining contact between the tachometer and the guide rail with one hand while operating the top of car inspection box with the other hand. Additionally, there are serious safety concerns any time that a technician is required to be on top of an elevator cab while it is moving through the hoistway.

U.S. Pat. No. 5,896,949 describes an elevator installation, in which the ride quality is actively controlled using a plurality of electromagnetic linear actuators. This active ride control system provides for an elevator car to travel along guide rails in a hoistway, wherein sensors mounted on the elevator car measure vibrations occurring transverse to the direction of travel. Signals from the sensors are input to a controller which computes the activation current required for each linear actuator to suppress the sensed vibrations. These activation currents are supplied to the linear actuators which actively dampen the vibrations and thereby the ride quality for passengers traveling within the car is enhanced. The controller comprises a position controller with position feedback, which is problematic for many reasons. For example, the position feedback controller is rather slow and the controller output is limited to a level to not cause overheating of the actuators. Further problems include that the output from the acceleration controller, is not restricted and thus produces large amplitude resonance forces at the actuators. Resulting in all closed loop controllers to become unstable if feedback gain is too high.

Therefore, a need exists in the art for an improved way to estimate motion of an elevator car of an elevator system that includes measuring one or a combination of speed and vibration of the elevator car within the elevator system for controlling the operation of the elevator system.

SUMMARY

Embodiments of the present disclosure are directed to estimating one or a combination of speed and vibration of an elevator car, for controlling an operation of an elevator system.

Some embodiments include estimating motion of the elevator car or a conveying machine, that measures a first direction of motion such as speed, and/or a second direction of motion such as vibration, for controlling the operation of the elevator system or the conveying machine.

The present disclosure is based on a realization that a hybrid sinusoidal frequency modulated (FM) and polynomial phase signal (PPS) can be used to estimate the motion of the elevator car of the elevator system. When the elevator car is moving in a dynamic motion or time-varying acceleration, measurements can be modeled as a pure PPS with the phase parameter associated to the kinematic parameters of the elevator car. For instance, the initial velocity and acceleration are proportional to the phase parameters, respectively.

Further, through experimentation in parameter estimation using the hybrid sinusoidal FM-PPS model, that in order to infer the motion of targets, we discovered that the parameter estimation can be used under stringent conditions. For example, when a sinusoidal FM frequency is small, i.e. having a low sinusoidal frequency, and/or when a number of samples obtained is limited, i.e., the response time for outputting the target motion parameter is very short, the present disclosure of using the hybrid sinusoidal FM-PPS model can improve estimation accuracy. In particular, at least one benefit, among many benefits, included using the hybrid sinusoidal FM-PPS model which provided for an improved estimation accuracy in terms of a mean squared error for several orders of magnitude. Thus, we learned the hybrid sinusoidal FM-PPS model could be used for many applications based upon setting thresholds for a response time for outputting the PPS phase parameters specific to a threshold time period, and/or for a sinusoidal FM phase parameter specific to a threshold sinusoidal FM frequency amount.

For example, if a threshold is set for a response time for outputting the PPS phase parameters is under a predetermine threshold time period, and/or if another threshold is set for the sinusoidal FM phase parameter that has a sinusoidal FM frequency less than a predetermine threshold sinusoidal FM frequency, then an action can be taken according to the specific application. At least one action, by non-limiting example, taken can be controlling a motion of the elevator car or a conveying machine. By controlling the motion of the elevator car at a moment of time there is an indication of some event, i.e. potential abnormal operation due mechanical related issues or envirnonmental conditions effecting current operation, such controlling action may provide for extending the operational health of the elevator system or improve safety of contents, i.e., people, in the elevator car. The present disclosure overcomes parameter estimation such as motion of an elevator of polynomial phase signals (PPSs) having only a finite or small number of samples, which is a fundamental problem in conventional applications, including radar, sonar, communications, acoustics and optics. Specifically, we learned that the present disclosure hybrid sinusoidal FM-PPS model overcomes such short comings, and despite a small sinusoidal FM frequency and/or limited number of samples, out performs by providing an improved estimation accuracy of the speed of the elevator car or the vibration of the elevator car.

We further realized the importance of understanding the sinusoidal FM component when estimating motion of the elevator car, i.e. conveying machine, when certain circumstances or scenarios arise. For example, a lateral vibration of the elevator car can effect estimating motion based upon several issues, for example, mechanical related problems, uneven load within the elevator car or a configuration geometry of the guide-rail reflecting surface, among other things. Despite both effects, we found that the matched filtered outputs follow the hybrid sinusoidal FM-PPS model.

To better understand how the systems and methods of the present disclosure may be implemented, we can provide a brief overview, by non-limiting example. It is contemplated depending upon the particular application, the systems and methods may be configured and implemented differently, or that additional aspects may be included. Never the less, for example, an initial step may include the elevator system having an elevator car that moves along a first direction. A transmitter maybe used for transmitting a signal having a waveform. A receiver maybe used for receiving the waveform, wherein the receiver and the transmitter are arranged such that motion of the elevator car effects the received waveform. Signal data is generated by the sensors, i.e. transmitter and receiver, relating to the motion of a movement of an elevator car of the elevator in a first direction. The signal data can be stored in memory or the signal data can be gathered and processed in real-time, depending upon the requirements of the particular application requested.

A processor has an internal memory and can acquire the signal data when the signal data is stored in memory or acquire the signal data in real time. The processor is configured to represent the received waveform as a hybrid sinusoidal frequency modulated (FM)-polynomial phase signal (PPS) model. The hybrid sinusoidal FM-PPS model has PPS phase parameters representing a speed of the elevator car along a first direction and a sinusoidal FM phase parameter representing a vibration of the elevator car along a second direction, and then solves the hybrid sinusoidal FM-PPS model to produce one or combination of the speed of the elevator car or the vibration of the elevator car.

Remember, when the elevator car is moving in a dynamic motion or time-varying acceleration, measurements can be modeled as a pure PPS with the phase parameter associated to the kinematic parameters of the elevator car, i.e. the initial velocity and acceleration are proportional to the phase parameters, respectively. We also realized the importance of the sinusoidal FM component when estimating motion of the elevator car, that the lateral vibration of the elevator car can effect estimating motion based upon mechanical issues, uneven load, etc.

We can solve for the hybrid sinusoidal FM-PPS model using several approaches, at least one approach includes using the PPS phase parameters and the sinusoidal FM phase parameter by computing a Local High-order Phase Function (LHPF), so as to extract peak locations. Then, estimate a sinusoidal FM frequency from the computed LHPF peak locations, followed by estimating the PPS phase parameters representing the speed of the elevator car along the first direction from the peak locations in the time-frequency rate domain of the received signal. It is noted that another approach for solving the hybrid sinusoidal FM-PPS model can include a local approximation of a high-order phase function, wherein the local approximation is based on a Taylor series expansion of a sinusoidal function. Further, the local approximation of the high-order phase function may also be based on other power series expansions or linear approximations.

Finally, a controller can be used to control an operation of the elevator system using one or combination of the speed of the elevator car or the vibration of the elevator car, so as to assist in an operational health management of the elevator system.

According to an embodiment of the present disclosure, an elevator system includes an elevator car to move along a first direction. A transmitter for transmitting a signal having a waveform. A receiver for receiving the waveform, wherein the receiver and the transmitter are arranged such that motion of the elevator car effects the received waveform. A processor having a computer readable memory is configured to represent the received waveform as a hybrid sinusoidal frequency modulated (FM)-polynomial phase signal (PPS) model. The hybrid sinusoidal FM-PPS model has PPS phase parameters representing a speed of the elevator car along a first direction and a sinusoidal FM phase parameter representing a vibration of the elevator car along a second direction, to solve the hybrid sinusoidal FM-PPS model to produce one or combination of the speed of the elevator car or the vibration of the elevator car. Finally, a controller to control an operation of the elevator system using one or combination of the speed of the elevator car or the vibration of the elevator car, so as to assist in an operational health management of the elevator system.

According to another embodiment of the present disclosure, a conveying machine method includes acquiring measurements generated from sensors in communication with the conveying machine over a period of time, to obtain a transmitted signal having a waveform. Wherein the sensors are arranged such that motion of the conveying machine effects the transmitted signal resulting in an effected received waveform. Further, wherein the conveying machine includes one of an elevator, a turbine of a conveying transport machine or a helicopter. A processor having a computer readable memory is configured to represent the received waveform as a hybrid sinusoidal frequency modulated (FM)-polynomial phase signal (PPS) model. The hybrid sinusoidal FM-PPS model has PPS phase parameters representing a speed of the conveying machine along a first direction and a sinusoidal FM phase parameter representing a vibration of the conveying machine along a second direction, to solve the hybrid sinusoidal FM-PPS model to produce one or combination of the speed of the conveying machine and the vibration of the conveying machine, that is stored in the computer readable memory. Finally, controlling via a controller an operation of the conveying machine using one or combination of the speed of the conveying machine and the vibration of the conveying machine, so as to assist in an operational health management of the conveying machine or assist in initiating a safety action via controlling the operation of the conveying machine, to protect contents conveyed by the conveying machine.

According to another embodiment of the present disclosure, a non-transitory computer readable storage medium embodied thereon a program executable by a computer for performing an elevator method. The elevator method including obtaining signal data generated from sensors relating to speed of a movement of an elevator car of the elevator in a first direction and storing the signal data in the non-transitory computer readable storage medium. Wherein an estimated speed of the movement of the elevator car in the first direction is estimated using a signal propagated along a second direction, and wherein the first direction is different from the second direction. Formulating, by a processor, the speed estimation of the movement of the elevator car as a hybrid sinusoidal frequency modulated (FM)-polynomial phase signal (PPS) model. The hybrid sinusoidal FM-PPS model has PPS phase parameters representing the sensed speed of the elevator car along the first direction and a sinusoidal FM phase parameter representing vibration of the elevator car along the second direction, to solve the hybrid sinusoidal FM-PPS model to update the speed of the elevator car. Finally, controlling an operation of the elevator car via a controller using one or combination of the speed of the elevator car and the vibration of the elevator car, so as to assist in an operational health management of the conveying machine or assist in initiating a safety action via controlling the operation of the conveying machine, to protect contents conveyed by the conveying machine.

BRIEF DESCRIPTION OF THE DRAWINGS

The presently disclosed embodiments will be further explained with reference to the attached drawings. The drawings shown are not necessarily to scale, with emphasis instead generally being placed upon illustrating the principles of the presently disclosed embodiments.

FIG. 5A represents the Taylor series expansion, and FIG. 5B represents an approximation error over $|\tau|\leq 26$, according to embodiments of the present disclosure;

FIG. 6A illustrates an original HPF in in a noise-free case and FIG. 6B illustrates the local HPF applied to the hybrid sinusoidal FM-PPS model with P=2 and $\omega_0=2\pi f_0$=0:0491, according to embodiments of the present disclosure;

Figure 1A:
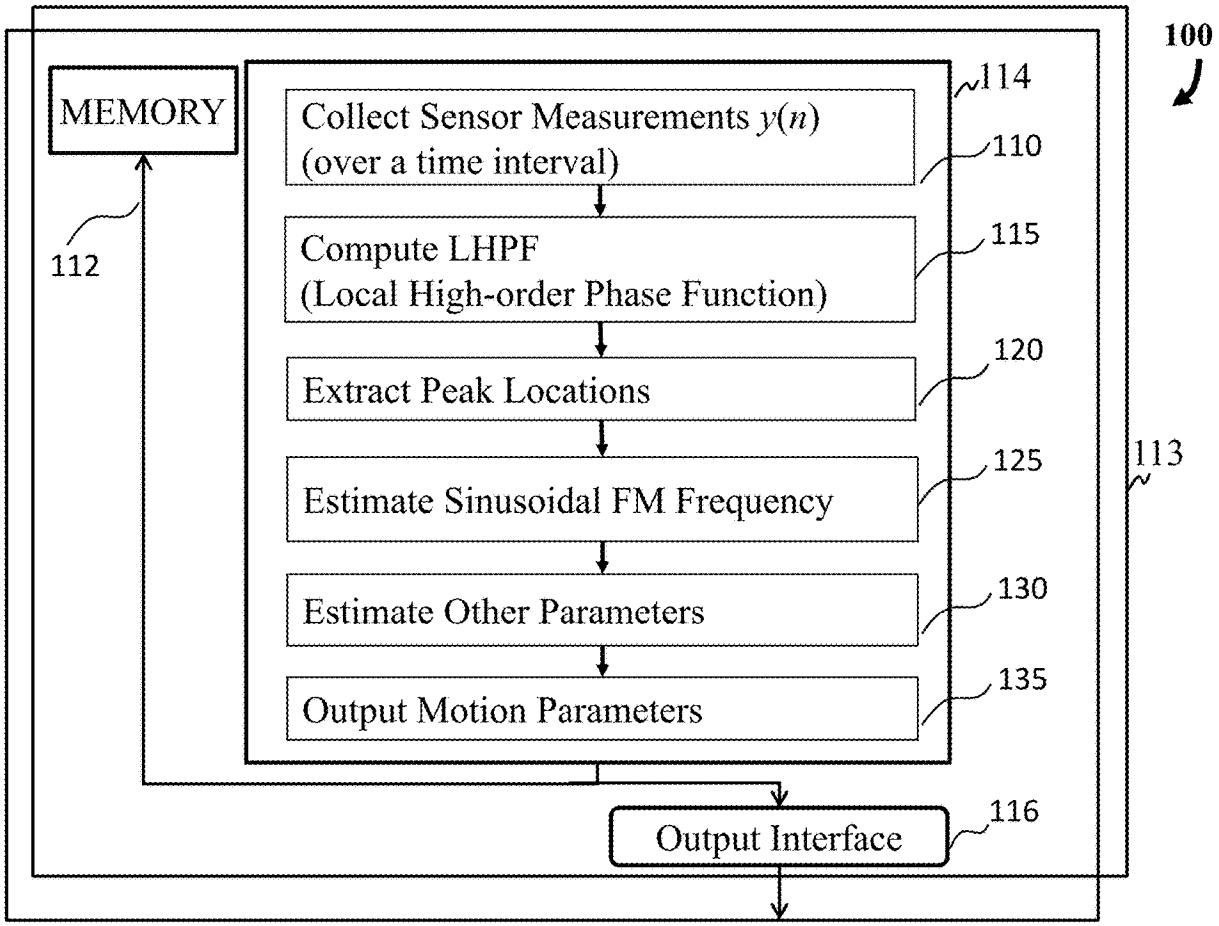
FIG. 1A is a block diagram illustrating a method for controlling an operation of the elevator system using one or combination of the speed of the elevator car or the vibration of the elevator car from a hybrid sinusoidal frequency modulated (FM)-polynomial phase signal (PPS) model having PPS phase parameters and a sinusoidal FM phase parameter, according to an embodiment of the present disclosure.

While the above-identified drawings set forth presently disclosed embodiments, other embodiments are also contemplated, as noted in the discussion. This disclosure presents illustrative embodiments by way of representation and not limitation. Numerous other modifications and embodiments can be devised by those skilled in the art which fall within the scope and spirit of the principles of the presently disclosed embodiments.

DETAILED DESCRIPTION

The following description provides exemplary embodiments only, and is not intended to limit the scope, applicability, or configuration of the disclosure. Rather, the following description of the exemplary embodiments will provide those skilled in the art with an enabling description for implementing one or more exemplary embodiments. Contemplated are various changes that may be made in the function and arrangement of elements without departing from the spirit and scope of the subject matter disclosed as set forth in the appended claims.

Specific details are given in the following description to provide a thorough understanding of the embodiments. However, understood by one of ordinary skill in the art can be that the embodiments may be practiced without these specific details. For example, systems, processes, and other elements in the subject matter disclosed may be shown as components in block diagram form in order not to obscure the embodiments in unnecessary detail. In other instances, well-known processes, structures, and techniques may be shown without unnecessary detail in order to avoid obscuring the embodiments. Further, like reference numbers and designations in the various drawings indicated like elements.

Also, individual embodiments may be described as a process which is depicted as a flowchart, a flow diagram, a data flow diagram, a structure diagram, or a block diagram. Although a flowchart may describe the operations as a sequential process, many of the operations can be performed in parallel or concurrently. In addition, the order of the operations may be re-arranged. A process may be terminated when its operations are completed, but may have additional steps not discussed or included in a figure. Furthermore, not all operations in any particularly described process may occur in all embodiments. A process may correspond to a method, a function, a procedure, a subroutine, a subprogram, etc. When a process corresponds to a function, the function's termination can correspond to a return of the function to the calling function or the main function.

Furthermore, embodiments of the subject matter disclosed may be implemented, at least in part, either manually or automatically. Manual or automatic implementations may be executed, or at least assisted, through the use of machines, hardware, software, firmware, middleware, microcode, hardware description languages, or any combination thereof. When implemented in software, firmware, middleware or microcode, the program code or code segments to perform the necessary tasks may be stored in a machine readable medium. A processor(s) may perform the necessary tasks.

Overview of Embodiments of the Present Disclosure

Embodiments include estimating motion of the elevator car that measures a first direction of motion such as speed, and/or a second direction of motion such as vibration, for controlling the operation of the elevator system.

The present disclosure includes an elevator system having an elevator car that moves along a first direction, and a transmitter transmits a signal having a waveform that is received by a receiver. Wherein the receiver and the transmitter are arranged such that motion of the elevator car effects the received waveform. A processor is configured to represent the received waveform as a hybrid sinusoidal frequency modulated (FM)-polynomial phase signal (PPS) model. The hybrid sinusoidal FM-PPS model has PPS phase parameters representing a speed of the elevator car along a first direction and a sinusoidal FM phase parameter representing a vibration of the elevator car along a second direction, used to solve the hybrid sinusoidal FM-PPS model and to produce one or combination of the speed of the elevator car or the vibration of the elevator car. Finally, a controller controls an operation of the elevator system using one or combination of the speed of the elevator car or the vibration of the elevator car, so as to assist in an operational health management of the elevator system.

According to embodiments of the present disclosure, the systems and methods address the elevator car as moving in a dynamic motion or time-varying acceleration, so measurements can be modeled as a pure PPS with the phase parameter associated to the kinematic parameters of the elevator car, i.e. the initial velocity and acceleration are proportional to the phase parameters, respectively. We realized an importance of a sinusoidal FM component when estimating motion of the elevator car, that the lateral vibration of the elevator car can effect estimating motion based upon mechanical issues, uneven load, etc.

For example, we realized the importance of understanding the sinusoidal FM component when estimating motion of the elevator car when certain circumstances or scenarios arise. We learned that lateral vibration of the elevator car can effect estimating motion based upon several issues, for example, mechanical related problems, uneven load within the elevator car or a configuration geometry of the guide-rail reflecting surface, among other things. Despite both effects, we found that the matched filtered outputs follow the hybrid sinusoidal FM-PPS model. Thus, under certain circumstances the vibration of the elevator car along a lateral direction (second direction) which is perpendicular to the up and down direction (first direction) of the elevator car may need to be considered when controlling an operation of the elevator system.

FIG. 1A is a block diagram illustrating a method 100 for controlling an operation of the elevator system using one or combination of the speed of the elevator car or the vibration of the elevator car from a hybrid sinusoidal frequency modulated (FM)-polynomial phase signal (PPS) model having PPS phase parameters and a sinusoidal FM phase parameter, according to an embodiment of the present disclosure. FIG. 1A shows a computer 113 having a processor 114, a memory 112 and an output interface 116.

Referring to Step 110 of FIG. 1A, includes acquiring signal data generated by sensors, i.e. transmitter and receiver, relating to motion of a movement of an elevator car of the elevator in a first direction. The signal data can be stored in memory or the signal data can be gathered and processed in real-time, depending upon the requirements of the particular application requested.

Step 115 of FIG. 1A, we can solve for the hybrid sinusoidal FM-PPS model using at least one approach using the PPS phase parameters and the sinusoidal FM phase parameter, by computing a Local High-order Phase Function (LHPF), so as to extract peak locations. Step 120 of FIG. 1A includes extract peak locations to estimate the PPS phase parameters and the sinusoidal FM phase parameter. Step 125 includes estimating a sinusoidal FM frequency from the computed LHPF peak locations. Step 130 includes estimating other parameter including the PPS phase parameters representing the speed of the elevator car along the first direction from the peak locations in the time-frequency rate domain of the received signal.

It is noted that another approach besides the LHPF approach may be used for solving the hybrid sinusoidal FM-PPS model, such as an approach using a local approximation of a high-order phase function. The local approximation can be based on a Taylor series expansion of a sinusoidal function. Further, the local approximation of the high-order phase function may also be based on other power series expansions or linear approximations depending upon the application.

Step 130 includes outputting the motion parameters via a controller can be used to control an operation of the elevator system using one or combination of the speed of the elevator car or the vibration of the elevator car, so as to assist in an operational health management of the elevator system.

Still referring to FIG. 1A, at least one advantage we realized through experimentation in parameter estimation using the hybrid sinusoidal FM-PPS model to infer motion of targets, we discovered that the parameter estimation can be used under stringent conditions. For example, when a sinusoidal FM frequency is small (or having a low sinusoidal frequency), and/or when a number of samples obtained is limited (or the response time for outputting the target motion parameter is very short); we found that the hybrid sinusoidal FM-PPS model of the present disclosure improves estimation accuracy. In particular, at least one aspect included using the hybrid sinusoidal FM-PPS model that provided for an improved estimation accuracy in terms of a mean squared error for several orders of magnitude.

Based on our discovery, we learned the hybrid sinusoidal FM-PPS model could be used for many applications by setting thresholds for a response time for outputting the PPS phase parameters specific to a threshold time period, and/or for a sinusoidal FM phase parameter specific to a threshold sinusoidal FM frequency amount. For example, if a threshold is set for a response time for outputting the PPS phase parameters is under a predetermine threshold time period, and/or if another threshold is set for the sinusoidal FM phase parameter that has a sinusoidal FM frequency less than a predetermine threshold sinusoidal FM frequency, then an action can be taken according to the specific application. At least one action, by non-limiting example, can be controlling a motion of the elevator car or a conveying machine. By controlling the motion of the elevator car at a moment of time there is an indication of some event, i.e. potential abnormal operation due mechanical related issues or environmental conditions effecting current operation, such controlling action may provide for extending the operational health of the elevator system or improve safety of contents, i.e., people, in the elevator car.

Figure 1B:
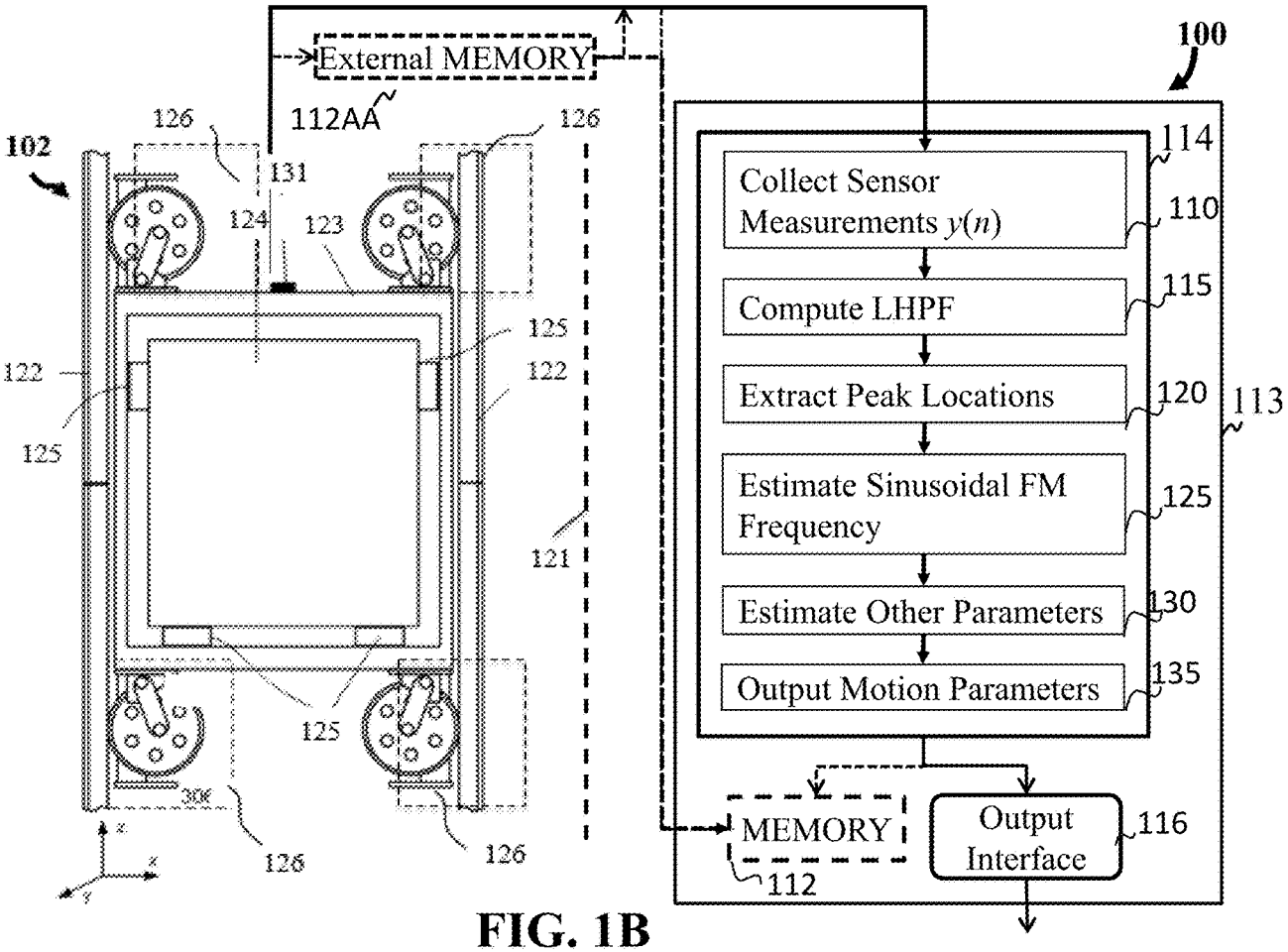
FIG. 1B is a block diagram illustrating the method and components of FIG. 1A, according to embodiments of the present disclosure.

FIG. 1B is a block diagram illustrating the method and components of FIG. 1A, according to embodiments of the present disclosure. FIG. 1B shows an elevator system 102 including an elevator car 124, a frame 123, four roller guide assemblies 126, and guide rails 122. The roller guides assemblies 126 act as a suspension system to minimize the vibration of the elevator car 124. The elevator car 124 and roller guide assemblies 126 are mounted on the frame 122. The elevator car 124 and frame 123 move along the guide rail 122 as constrained by the guide rollers assemblies 126. There can be two principal disturbances which contribute to the levels of vibration in the elevator car 124, first rail-induced forces which are transmitted to the elevator car 124 through the rail guides due to rail irregularities, and second direct-car forces such as produced by wind buffeting the building, passenger load distribution or motion. Thus, under certain circumstances the vibration of the elevator car 124 along a lateral direction needs to be considered when controlling an operation of the elevator system.

By non-limiting example, if the elevator system was experiencing an abnormal behavior due to mechanical problems, and some indication of such mechanical problems can be sensed via vibrations, then having such knowledge may assist in the operational health management of the elevator system. Further, by non-limiting example, if some environmental event(s) or natural disaster was occurring, that produced serve vibration to the elevator system, and causing an abnormal operation or lead to potential failure of the elevator system. Then, if some indication or warning of potential abnormal behavior or potential failure can be provided by detection of vibration of the elevator system, such early warning system could save the operational health management of the elevator system or enhance safety of occupants in the elevator car during such environmental or natural disaster events.

Still referring to FIG. 1B, FIG. 1B illustrates how the signal data of step 110 of FIG. 1A can be collected from the elevator system 102. The elevator system 102 includes an elevator car 124 that moves along a first direction (z-axis). Sensors 131 can be used, wherein a transmitter can transmit a signal having a waveform, and a receiver can receive the waveform. Depending upon the application a sensor 131 may be located on the elevator car 124 and another sensor may be located on the frame 122 of the elevator system 102 or some other location. The present disclosure contemplates using different types of sensors as well as sensor locations, as noted above, within the elevator system 102 to obtain the signal data. The receiver and the transmitter are arranged such that motion of the elevator car 124 effects the received waveform. The signal data can be gathered and processed in real-time via the processor 114, depending upon the requirements of the particular application requested. The signal data may be optionally stored in an external memory 112AA and processed by processor 114 or stored in memory 112, or stored directly to memory 112 and then processed by the processor 114.

It is noted that the conveying system may include applications involving transportation of people, heavy or bulky materials and the like. For example, the conveyor system can include an ability to detect motion of at least one part of the conveyor system wherein the moving part of the conveyor system, i.e. target, introduces a pure PPS component with kinematic parameters related to PPS phase parameters, along with rotating parts (e.g., rotating blades of a helicopter) and target vibration (e.g., jet engine) that introduce a sinusoidal FM component.

Figure 1C:
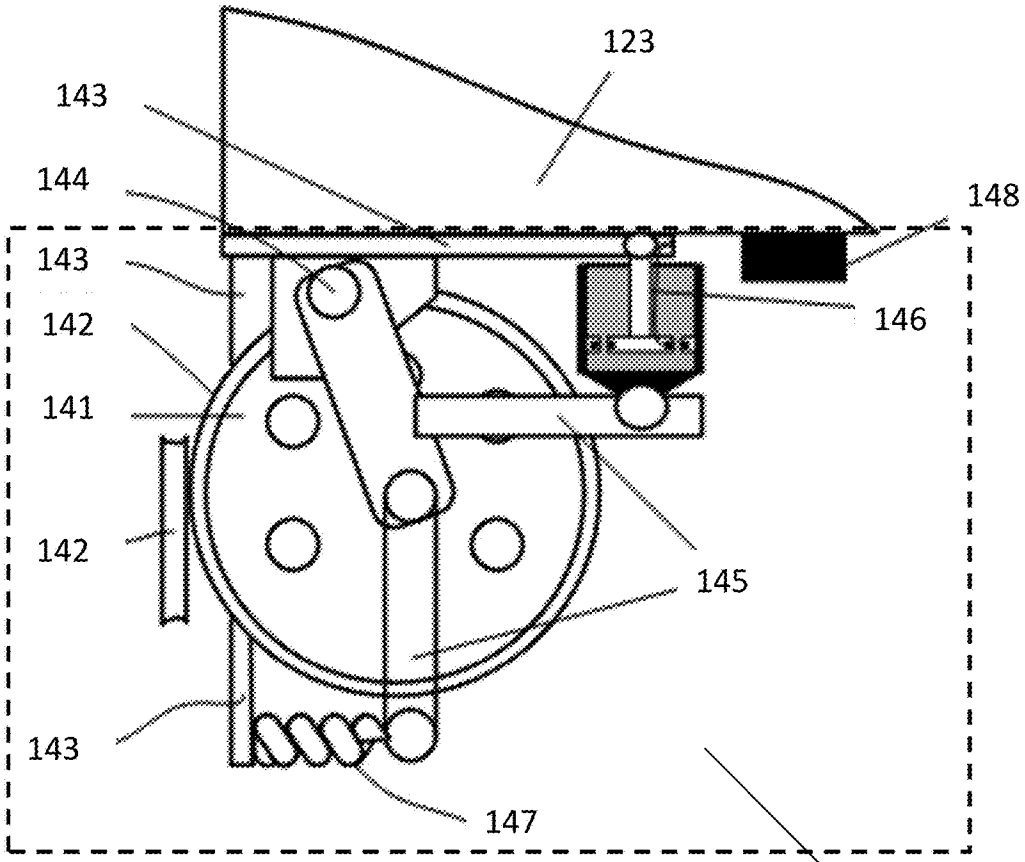
FIG. 1C is a block diagram illustrating the method and further components of FIG. 1A and FIG. 1B, according to embodiments of the present disclosure.

FIG. 1C is a block diagram illustrating the method and further components of FIG. 1B, according to embodiments of the present disclosure. FIG. 1C shows a part of a roller guide assembly 126 with a center roller 141 serving to minimize the vibration of the elevator car in the right-to-left direction (x-axis). In particular, FIG. 1C shows a controller 148 that actuate a semi-active actuator 146 that can control the operation of the elevator car. Wherein a center roller 141 maintains contact with the guide rail 122 through a roller gum 142. The roller is mounted on a base 143 of the frame 123, and can rotate around a pivot 144 whose axis is along a front to back direction (y-axis). A rotation arm 145 rotates at the same angular velocity as the roller around the pivot 144. In one embodiment, a semi-active actuator 146 is installed between the frame base 143 and the rotation arm 145. A roller spring 147 is installed between the rotation arm 145 and the frame base 143.

Referring back to FIG. 1B, a level variation of the guide rails 122 can cause the rotation of the roller around the pivot. The rotation of the roller induces the lateral movement of the frame 123 or vibration, due to a coupling between the rotation arm and the frame base through the roller spring, i.e. the level variation of the guide rails is a source of the disturbances. The lateral movement of the frame further induces the movement of the elevator car 124 by their coupling (support rubbers) 125. The elevator car 124 moves in either front to back (y-axis) and/or left to right (x-axis) directions.

Figure 1D:
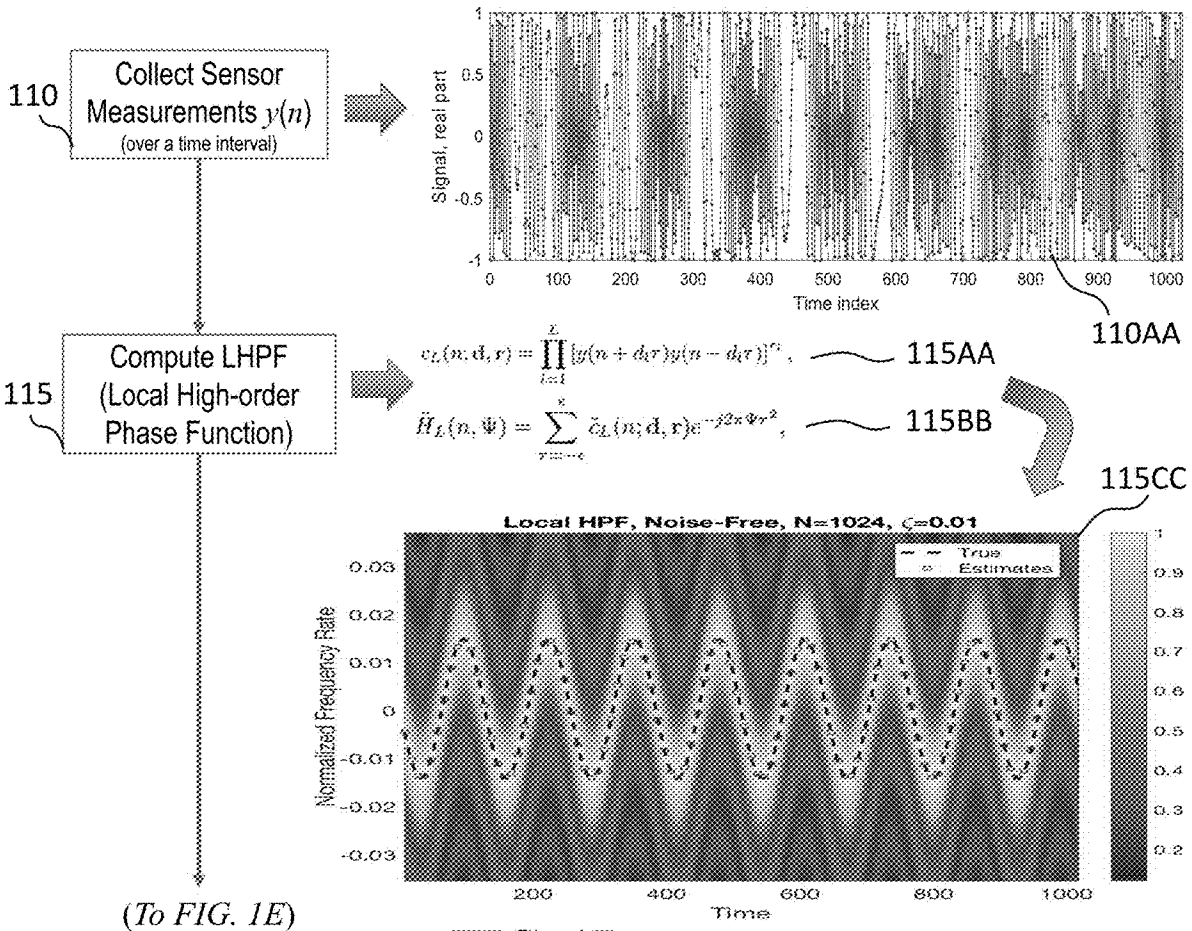
FIG. 1D and FIG. 1E illustrate the method of FIG. 1A, FIG. 1B and FIG. 1C, as how the present disclosure may solve the hybrid sinusoidal FM-PPS model, according to an embodiment of the present disclosure.
Figure 1E:
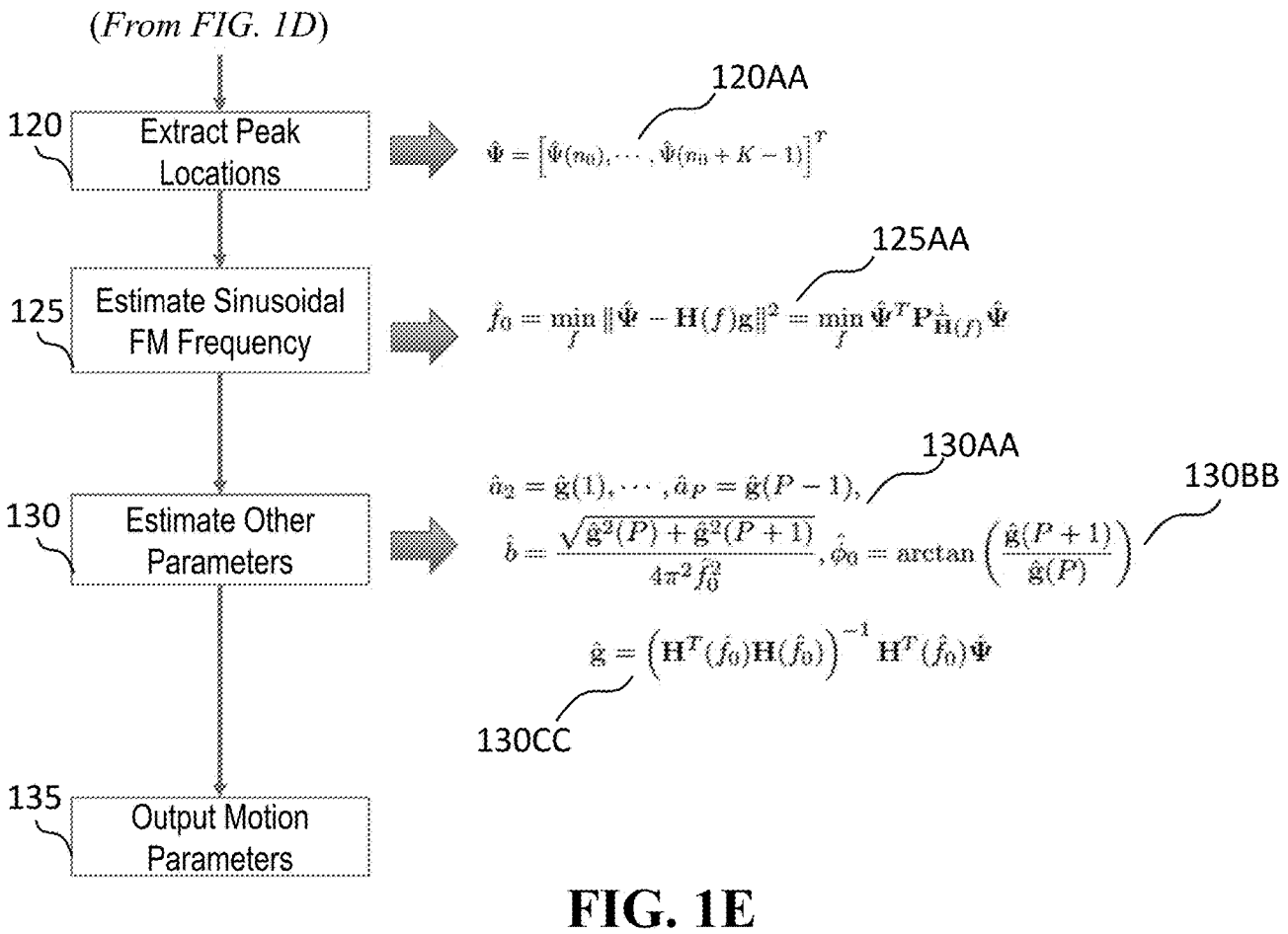

FIG. 1D and FIG. 1E illustrate the method of FIG. 1A, as to how the present disclosure may solve the hybrid sinusoidal FM-PPS model, according to an embodiment of the present disclosure.

Step 110 of FIG. 1D, includes acquiring signal data generated by sensors, i.e. transmitter and receiver, relating to motion of a movement of an elevator car of the elevator in a first direction. The signal data can be stored in memory or the signal data can be gathered and processed in real-time, depending upon the requirements of the particular application requested. Graph 110AA illustrates the signal data over a time interval.

Step 115 of FIG. 1D, solves for the hybrid sinusoidal FM-PPS model using the Local High-order Phase Function (LHPF), using equations 115AA and 115BB to obtain graph 115CC. Graph 115CC illustrates a time-frequency rate representation of a local Cubic Phase Function (CPF) applied to the hybrid sinusoidal FM-chirp signal with $f_0$=390:7254 Hz and N=1024 in the noise-free scenario (see FIG. 2).

Step 120 of FIG. 1E includes extracting peak locations to estimate the PPS phase parameters and the sinusoidal FM phase parameter using equation 120AA.

Step 125 of FIG. 1E includes estimating a sinusoidal FM frequency from the computed LHPF peak locations using equation 125AA.

Step 130 of FIG. 1E includes estimating other parameter including the PPS phase parameters representing the speed of the elevator car along the first direction from the peak locations in the time-frequency rate domain of the received signal, using equations 130AA, 130BB and 130CC.

Step 135 of FIG. 1E includes outputting the motion parameters via a controller can be used to control an operation of the elevator system using one or combination of the speed of the elevator car or the vibration of the elevator car, so as to assist in an operational health management of the elevator system.

Figure 2:
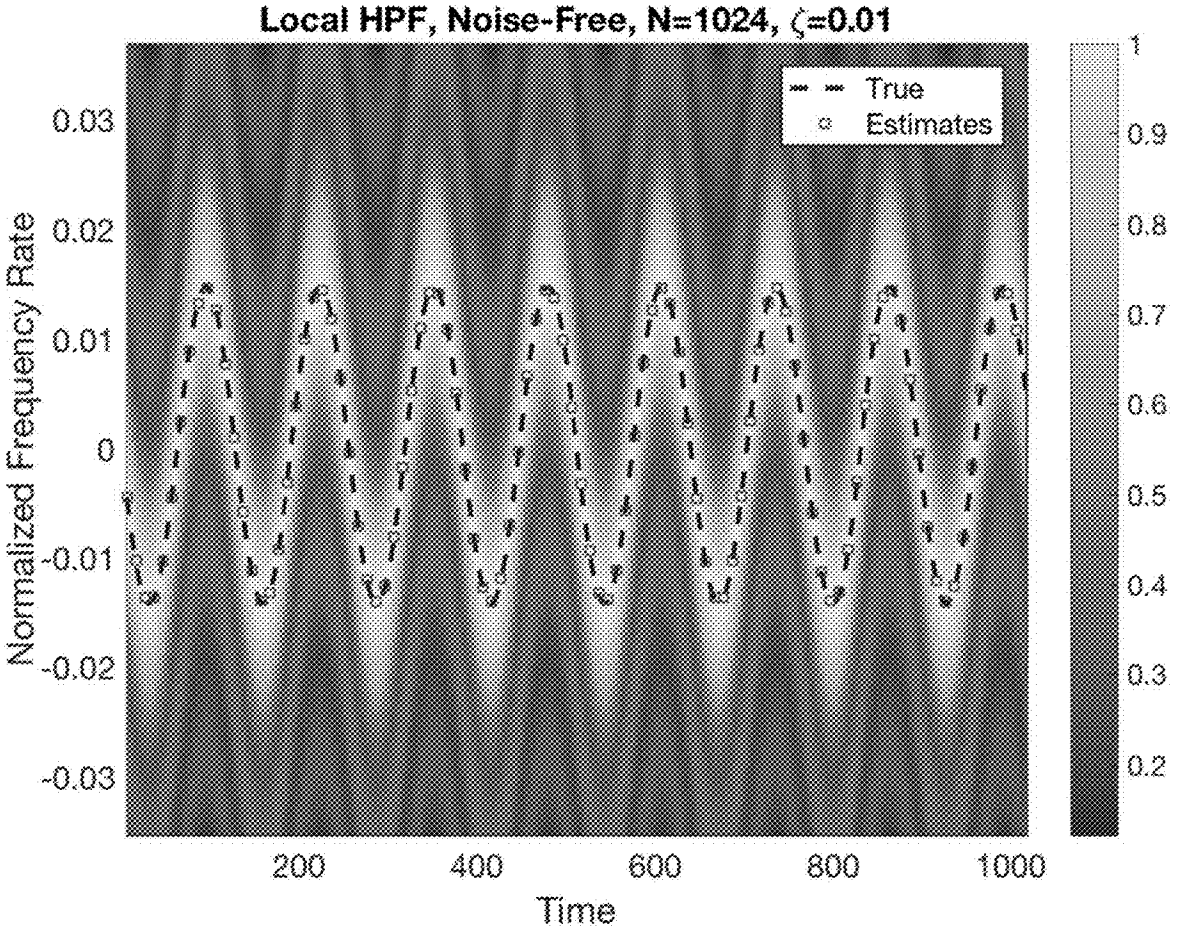
FIG. 2 is a graph illustrating a time-frequency rate representation of a local Cubic Phase Function (CPF) applied to the hybrid sinusoidal FM-chirp signal with $f_0$=390:7254 Hz and N=1024 in the noise-free scenario, according to some embodiments of the invention.
Figure 5A:
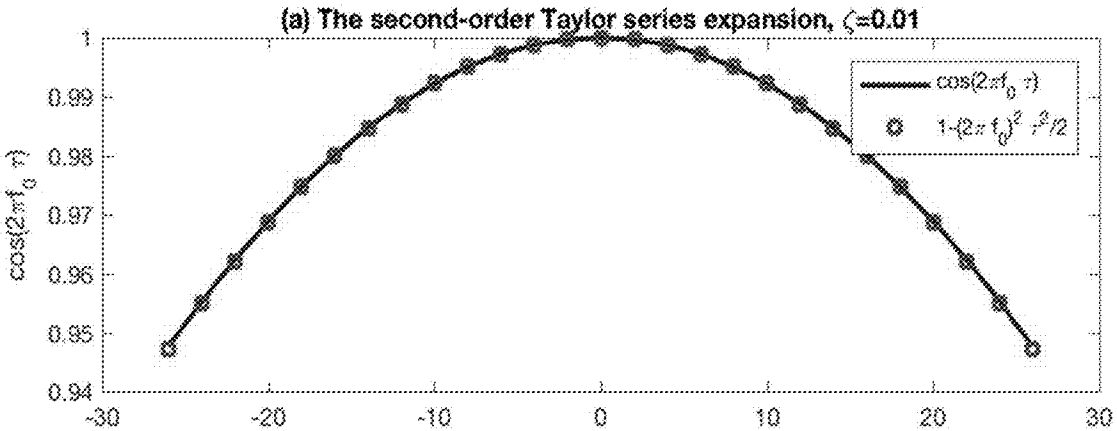
FIG. 5A and FIG. 5B are graphs illustrating a Taylor Series Expansion.

FIG. 2 is a graph illustrating a time-frequency rate representation of a local Cubic Phase Function (CPF) applied to the hybrid sinusoidal FM-chirp signal with $f_0$=390:7254 Hz and N=1024 in the noise-free scenario, according to some embodiments of the invention. Specifically, FIG. 2 illustrates a same case as in FIG. 5A, that is to be discussed below.

Figure 3:
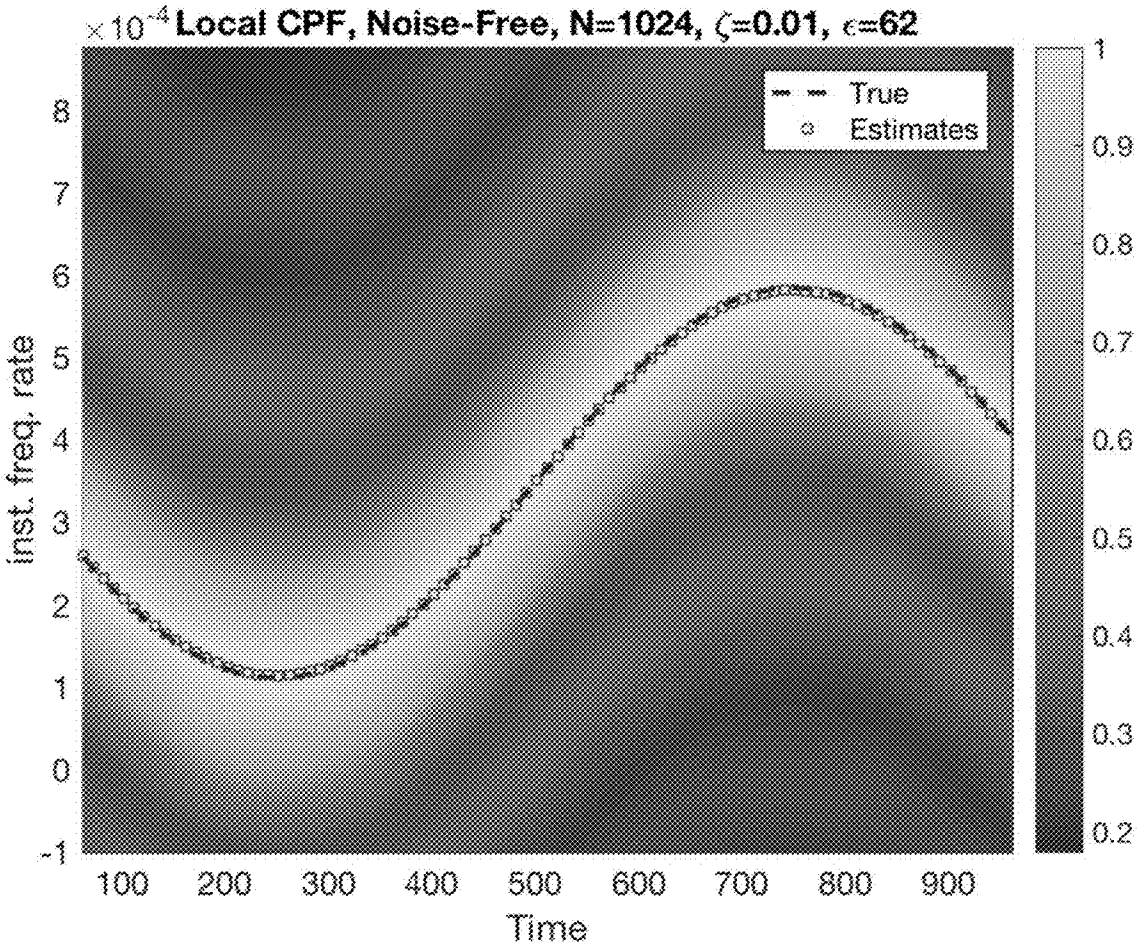
FIG. 3 is a graph illustrating the time-frequency rate representation of the local Cubic Phase Function (CPF) applied to the hybrid sinusoidal FM-chirp signal with $f_0$=50 Hz and N=1024 in the noise-free scenario, according to embodiments of the present disclosure.
Figure 5B:
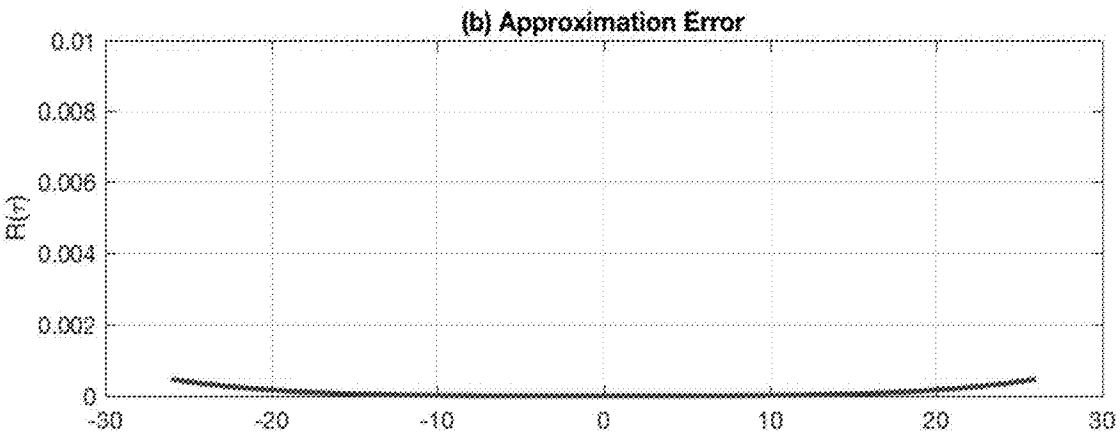

FIG. 3 is a graph illustrating the time-frequency rate representation of the local Cubic Phase Function (CPF) applied to the hybrid sinusoidal FM-chirp signal with $f_0$=50 Hz and N=1024 in the noise-free scenario, according to embodiments of the present disclosure. Specifically, FIG. 3 illustrates a same case as in FIG. 5B, that is to be discussed below.

Figure 4:
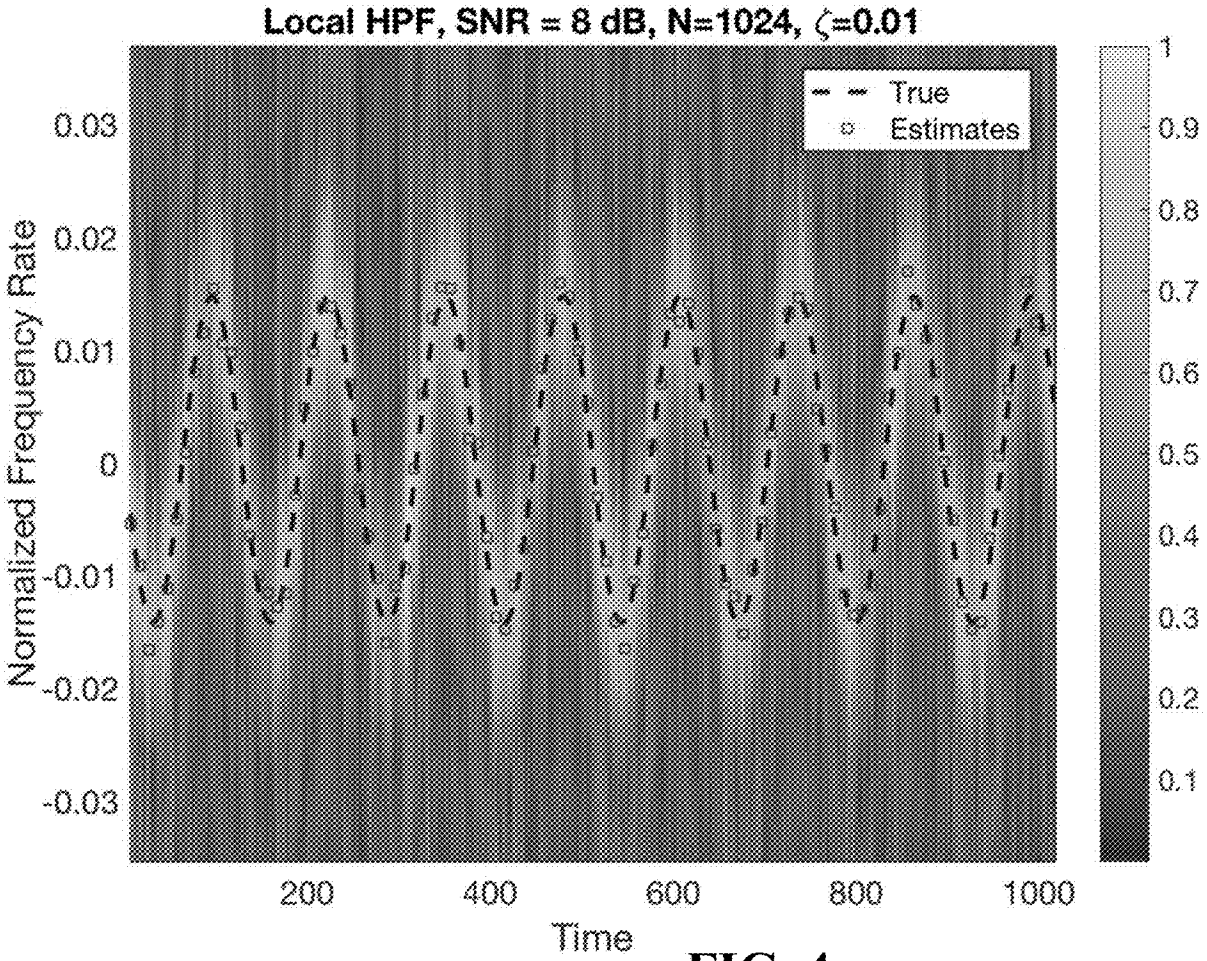
FIG. 4 is a graph illustrating the time-frequency rate representation of the local Cubic Phase Function (CPF) applied to the hybrid sinusoidal FM-chirp signal with $f_0$=390:7254 Hz, N=1024 and signal-to-noise ratio (SNR)=8 dB, according to embodiments of the present disclosure.

FIG. 4 is a graph illustrating the time-frequency rate representation of the local Cubic Phase Function (CPF) applied to the hybrid sinusoidal FM-chirp signal with $f_0$=390:7254 Hz, N=1024 and signal-to-noise ratio (SNR)=8 dB, according to embodiments of the present disclosure. Table 1 below illustrates a bias and variance of parameter estimation (SNR=8 dB).

TABLE 1

| | $\hat{b}$ | $\hat{\omega}_0$ | $\hat{a}_2$ |
|---|---|---|---|
| Bias (HAF) | −4.1559 | $-7.6639 \cdot 10^{-5}$ | $-4.3700 \cdot 10^{-7}$ |
| Var (HAF) | $1.1172 \cdot 10^{4}$ | $3.1892 \cdot 10^{-8}$ | $5.6254 \cdot 10^{-13}$ |
| Bias (Proposed) | −0.0597 | $1.6237 \cdot 10^{-5}$ | $-6.5056 \cdot 10^{-7}$ |
| Var (Proposed) | 0.0036 | $2.6365 \cdot 10^{-10}$ | $4.2322 \cdot 10^{-13}$ |

The embodiments of the present disclosure estimate the parameters of the hybrid sinusoidal FM-chirp signal. Specifically, the hybrid sinusoidal FM-PPS can be defined as $$y(n) = x(n) + v(n),\ n = 0, 1, \ldots, N-1, \quad = Ae^{j2\pi b\sin(2\pi f_0 + n + \phi_0)}e^{j2\pi\sum_{p=0}^{P} a_p n^{p/p!}} + v(n) \tag{2}$$

where A is the unknown amplitude, b>0 is the sinusoidal FM modulation index, $f_0$ is the sinusoidal FM frequency, $\phi_0$ is the initial phase, $\{a_p\}_{p=0}^{P}$ are the PPS phase parameters, P is the polynomial order, v(n) is the white Gaussian noise with an unknown variance $\sigma^2$, and N is the number of samples.

Original High-order Phase Function

The original HPF employs the following nonlinear transform $$c_L(n;,) = \prod_{l=1}^{L} [y(n + d_l\tau)y(n - d_l\tau)]^{r_l}, \tag{3}$$

where=[$d_1$, . . . , $d_L$],=[$r_1$, . . . , $r_L$], $[\cdot]^{r_l}$ denotes the conjugation if $r_l$=−1, and $\tau \in \Gamma(n)$ with $\Gamma(n)$ denoting the feasible range of $\tau$ at time n. For a pure PPS, the HPF selects the coefficients and such as $\Sigma_{l=1}^{L} r_l d_l^2=1$ and $\Sigma_{l=1}^{L} r_l d_l^m=0$ for even values of $4 \le m \le P$, and integrates the nonlinear kernel along $\tau^2$, $$H_L(n, \Psi) = \sum_{\tau \in \Gamma(n)} c_L(n;,)e^{-j2\pi\Psi\tau^2}, \tag{4}$$

where $\Psi$ is the index for the instantaneous frequency rate (IFR), i.e., the second-order phase derivative. It can be shown that, for any given time n, the squared magnitude of $H_L(n,\Psi)$ is centered on IFR(n)=$\Sigma_{p=2}^{P-2} a_p n^{p-2}/(p-2)!$ due to the match filtering in (4).

The Proposed Estimator

Figure 6A:
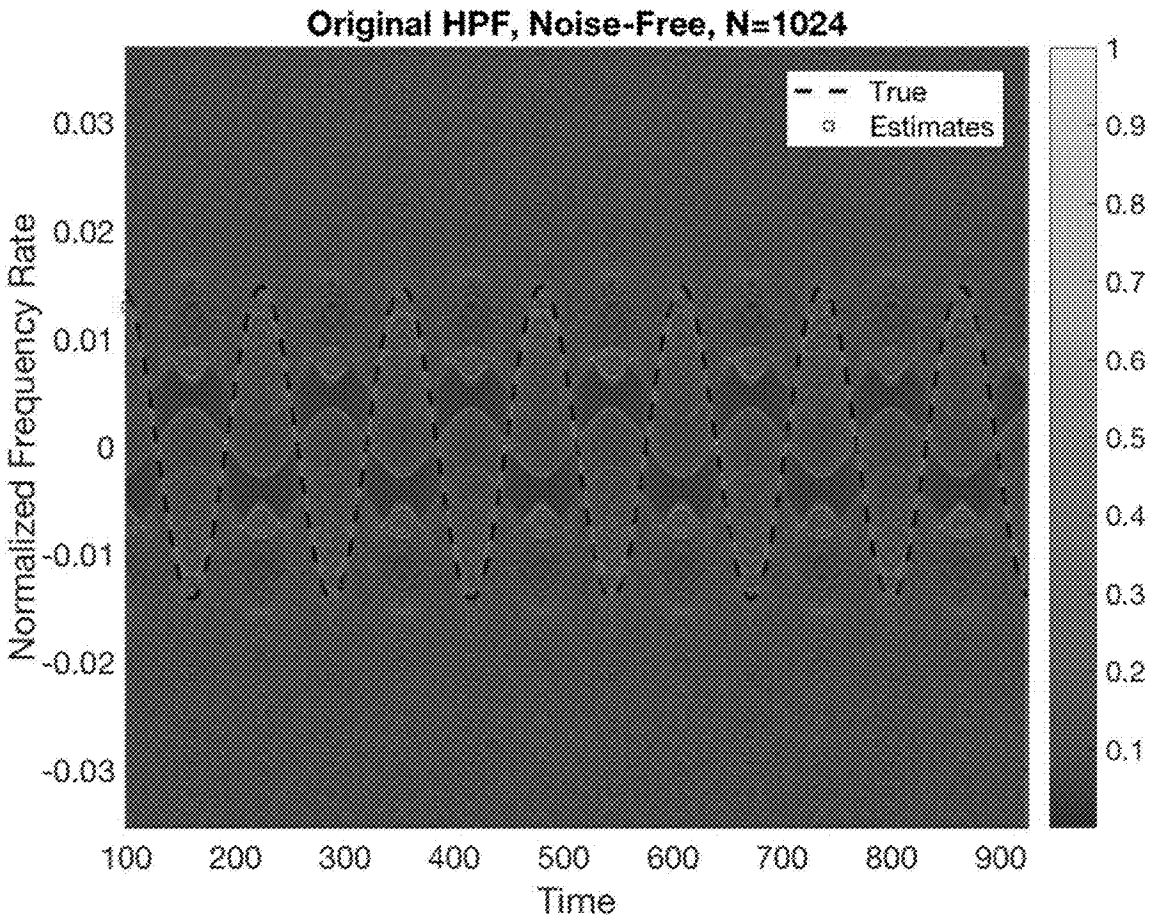
FIG. 6A and FIG. 6B are graphs illustrating experimentation in developing the hybrid sinusoidal FM-PPS model.
Figure 6B:
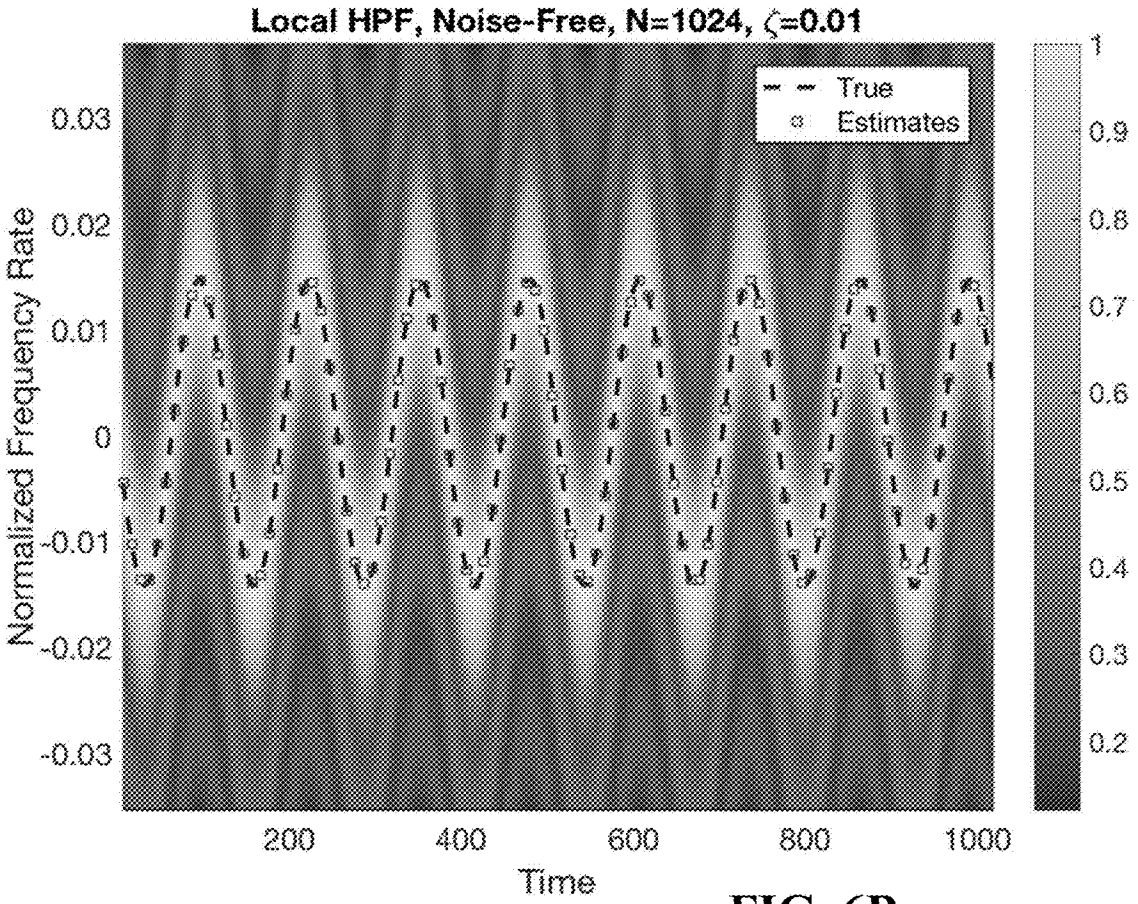

FIG. 6A and FIG. 6B are graphs illustrating experimentation in developing the hybrid sinusoidal FM-PPS model, FIG. 6A illustrates an original HPF in in a noise-free case and FIG. 6B illustrates the local HPF applied to the hybrid sinusoidal FM-PPS model with P=2 and $\omega_0=2\pi f_0$=0:0491, according to embodiments of the present disclosure.

For the hybrid signal in (2), the nonlinear kernel of (3) gives $$c_L(n;,) = A^{2L}e^{j2\pi\varphi}e^{j2\pi IFR(n)\tau^2}e^{j4\pi b\sin(2\pi f_0 n + \phi_0)\sum_{l=1}^{L} r_l \cos(2\pi f_0 d_l \tau)}. \tag{5}$$

It is seen that the first two exponential terms are related to the PPS component with $\varphi$ independent of $\tau$ and IFR(n) associated with $\tau^2$. The last exponential term is from the sinusoidal FM component and is nonlinear (via cos(•)) over $\tau$. Therefore, directly integrating $c_L(n;,)$ over $\tau \in \Gamma(n)$ cannot coherently accumulate the signal energy along $\tau^2$.

To coherently integrate the kernel over $\tau^2$, we locally approximate $\cos(2\pi f_0 d_l \tau)$ by its Taylor series expansion, i.e., $$\cos(2\pi f_0 d_l \tau) \approx 1 - \frac{(2\pi f_0)^2\tau^2}{2}d_l^2,\ |\tau| \le \varepsilon \tag{6}$$

where $\varepsilon$ defines a local region around $\tau$=0. With (6), the local kernel of is given as $$\tilde{c}_L(n;,) = A^{2L}e^{j2\pi\varphi}e^{j4\pi b\sin(2\pi f_0 n + \phi_0)\sum_{l=1}^{L} r_l}e^{j2\pi[IFR(n) - b\sin(2\pi f_0 n + \phi_0)(2\pi f_0)^2]\tau^2},\quad |\tau| \le \varepsilon, \tag{7}$$

where we have used the fact that $\tau_{l=1}^{L} r_l d_l^2=1$. Then the local HPF integrates the local kernel over $-\varepsilon \le \tau \le \varepsilon$ $$\tilde{H}_L(n, \Psi) = \sum_{\tau=-\varepsilon}^{\varepsilon} \tilde{c}_L(n;,)e^{-j2\pi\Psi\tau^2}, \tag{8}$$

which achieves the maxima along the trajectory $$\Psi(n) = \sum_{p=2}^{P} \frac{a_p n^{p-2}}{(p-2)!} - 4\pi^2 f_0^2 b\sin(2\pi f_0 n + \phi_0). \tag{9}$$

It is seen that the local HPF embeds the parameters of interest ($\{a_p\}_{p=2}^{P}$,b,$f_0$,$\phi_0$) into peak locations. For the pure PPS, i.e., b=0 , the local HPF forms the peak ridge along its IFR(n).

Example of Comparison Between the Original and Proposed Local HPFs

We consider a hybrid sinusoidal FM-PPS. As a reminder, the signal model is given as $$y(n) = Ae^{j2\pi b\sin(2\pi f_0 + n + \phi_0)}e^{j2\pi\sum_{p=0}^{P} a_p n^{p/p!}} + v(n)$$

where P=2 in this example. The signal parameters are given as A=1, b=b 6, $\varphi_0$=0, $a_0$=0.5, $a_1$=0.1, $a_2=3.4722 \cdot 10^{-4}$, $\omega_0=2\pi f_0$=0.0491 and N=1024.

FIG. 6A shows the original HPF in the noise-free case. It clearly shows that the original HPF, designed for the pure PPS, fails to form peaks in the time-frequency rate domain. By comparison, we can use the proposed local HPF with L=1,$d_1$=1, and $r_1$=1:

$$H_1(n, \Psi) = \sum_{\tau=-\varepsilon}^{\varepsilon} y(n+\tau)y(n-\tau)e^{-j2\pi\Psi\tau^2}. \quad (10)$$

The local HPF in FIG. 6B shows distinct peaks along the true trajectory.

FIG. 6A illustrates the original HPF and the proposed local HPF of (10) in FIG. 6B applied to the hybrid FM-PPS with P=2 and $\omega_0=2\pi f_0=0.0491$.

Parameter Estimation

From (9), we can extract the peak locations and estimate these parameters by the following steps. First, group K peak locations $\hat{\Psi}=[\hat{\Psi}(n_0), \ldots, \hat{\Psi}(n_0+K-1)]^T$, construct the matrix $H(f)=[n_2, \ldots, n_p, s(f), c(f)]$ with columns given as $$n_p=[n_0^{P-2}/(p-2)!, \ldots, n_{n_0+K-1}^{P-2}/(p-2)!]^T,$$

$$s(f)=[\sin(2\pi f n_0), \ldots, \sin(2\pi f(n_0+K-1))]^T,$$

$$c(f)=[\cos(2\pi f n_0), \ldots, \cos(2\pi f(n_0+K-1))]^T, \quad (11)$$

and solve the following least square problem $$\hat{f}_0 = \min_f P\hat{\Psi} - H(f)gP^2 = \min_f \hat{\Psi}^T P_{H(f)}^{\perp}\hat{\Psi} \quad (12)$$

where is a (P+1)×1 linear parameter vector and $P_{H(f)}^{\perp}=I-H(f)(H^T(f)H(f))^{-1}H^T(f)$ is the projection matrix. With the estimated $\hat{f}_0$, we have $$\hat{g}=(H^T(\hat{f}_0)H(\hat{f}_0))^{-1}H^T(\hat{f}_0)\hat{\Psi}. \quad (13)$$

Then the remaining (P+1) parameters can be estimated as $$\hat{a}_2 = \hat{g}(1), \ldots, \hat{a}_P = \hat{g}(P-1), \quad (14)$$

$$\hat{b} = \frac{\sqrt{\hat{g}^2(P) + \hat{g}^2(P+1)}}{4\pi^2 \hat{f}_0^2},$$

$$\hat{\phi}_0 = \arctan\left(\frac{\hat{g}(P+1)}{\hat{g}(P)}\right).$$

With the above estimated parameters, we can demodulate the original signal as $\hat{y}(n)=y(n)e^{-j2\pi\hat{b}\ \sin(2\pi\hat{f}_0 n-\hat{\Phi}_0)}e^{-j2\pi\Sigma_{p=2}^{\hat{a}_p n_p}{}_{p1}{}^{P}}$ and estimate the remaining parameters, $\{A, a_0, a_1\}$, *by the conventional single-tone parameter estimation algorithm.*

The Choice of ε

From the above discussion, it is clear that the Taylor series expansion in (6) is critical to the local HPF of (9). The number of samples included in the integration in (9) may be limited due to the local region ε is too small. On the other hand, ε cannot be arbitrarily large since the second-order Taylor expansion cannot hold. In the following, we use the remainder term of the Taylor series expansion to determine an upper bound of ε for a given approximation error. Define $z=2\pi f_0$ and, hence, $$f(z) = \cos(2\pi f_0 d_l \tau) = \cos(z) \approx 1 - \frac{z^2}{2}.$$

The remainder term $R(z)=f(z)-(1-z^2/2)$ can be shown as $R(z)=\sin(z_c)z^3/6$ where $z_c$ is a real number between 0 and z. As a result, we have $|R(z)|=|\sin(z_c)z^3/6|\leq|z|^3/6$. For a given upper bound ζ on the approximation error, the maximum local region ε can be determined as $|R(z)|\leq|z|^3/6=\zeta\rightarrow|z|\leq(6\zeta)^{1/3}$ which is equivalent to $$|\tau|\leq\varepsilon=(6\zeta)^{1/3}/(2\pi d_{max}f_{0,max}) \quad (15)$$

where $d_{max}$ is the largest $d_l$ and $f_{0,max}$ is the upper limit on $f_0$. As shown in FIG. 6A and FIG. 6B, we compare $\cos(2\pi d_l f_0\tau)$ with its Taylor expansion of (6) over $|\tau|\leq\varepsilon=26$. The local region is determined by using (15) with a bound $\zeta=0.01$ and $2\pi d_{max}f_{0,max}=0.015$. It is seen that the second-order Taylor expansion holds well and the approximation error (in the bottom plot) is well below the given bound at $\zeta=0.01$.

Computational Complexity

Figure 7:
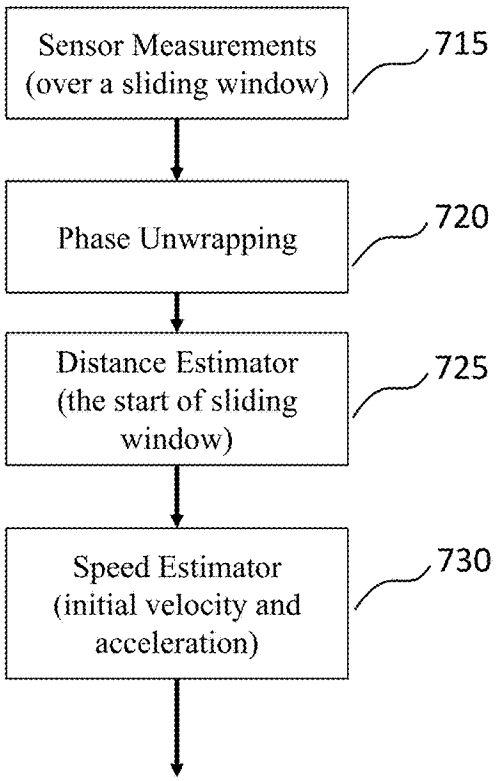
FIG. 7 is a block diagram illustrating an aspect of a method, according to embodiments of the present disclosure.

FIG. 7 is a block diagram illustrating an aspect of a method, according to embodiments of the present disclosure. FIG. 7 shows the step 715 of the sensor measurements over a sliding window. Step 720 shows the phase of unwrapping and step 725 shows the distance estimator, via the start of the sliding widow. Step 730 shows the speed estimator, i.e. the velocity and acceleration.

We provide a brief comparison in terms of computational complexity. For the ML method, it requires $o(N^{P+3})$ operations and the complexity is prohibitively high when the PPS order P is large. The PULS method requires o(N log N) for the phase unwrapping step and $o(N^2)$ for the the one-time NLS fitting of (17) [?]. For the proposed LHPF method, it has similar complexity to the PULS method. The difference is that the proposed method uses o(εN log ε) operations to calculate the LHPF of (9) with the fast algorithm of [?], where ε<N. The complexity of the HAF-based method is slightly higher than the PULS and LHPF methods as it takes $o(N^2\log N)$ operations to compute the HAF, followed by the one-time NLS fitting.

Figure 8:
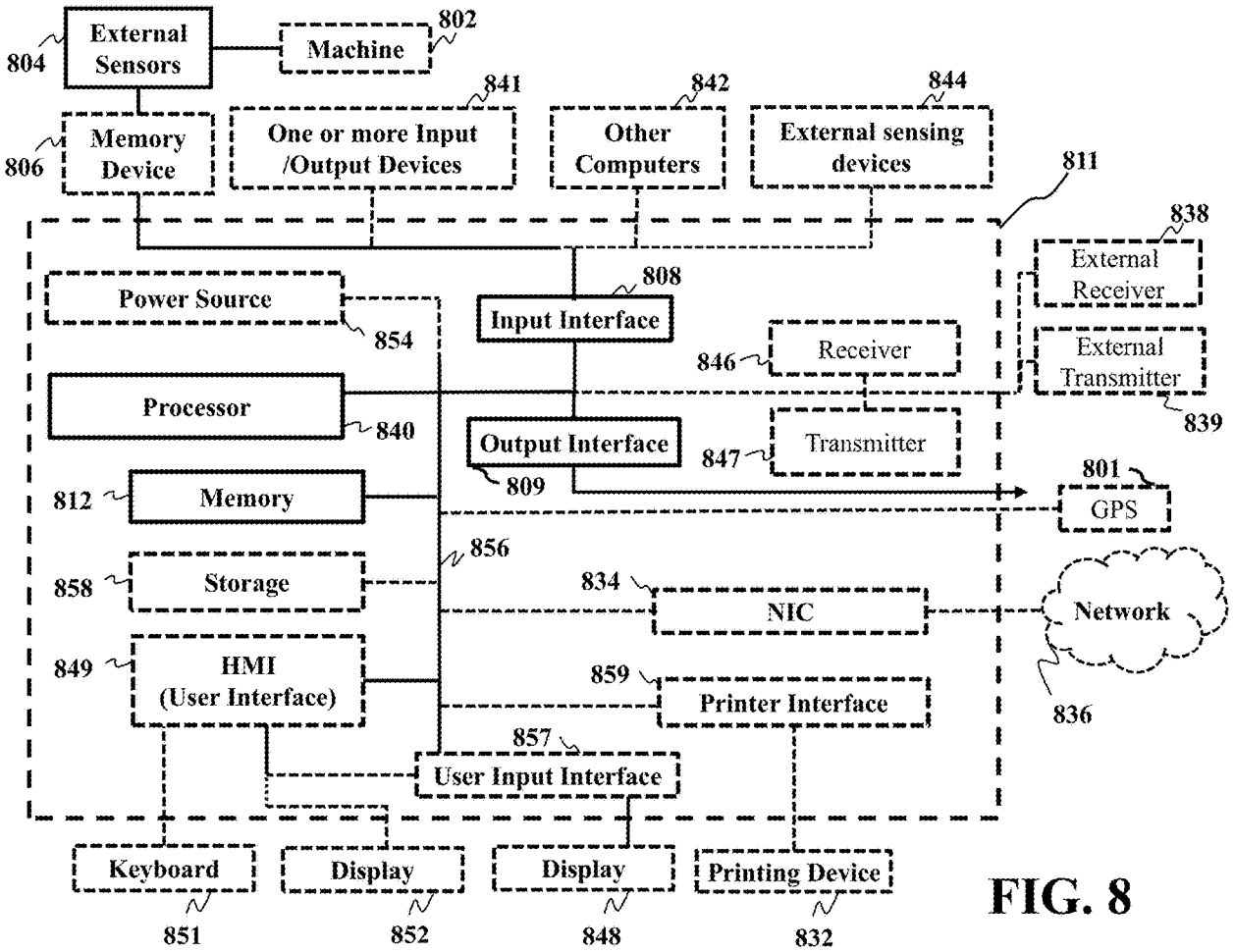
FIG. 8 is a block diagram illustrating the method of FIG. 1A, that can be implemented using an alternate computer or processor, according to embodiments of the present disclosure.

FIG. 8 is a block diagram of illustrating the method of FIG. 1A, that can be implemented using an alternate computer or processor, according to embodiments of the present disclosure. The computer 811 includes a processor 840, computer readable memory 812, storage 858 and user interface 849 with display 852 and keyboard 851, which are connected through bus 856. For example, the user interface 864 in communication with the processor 840 and the computer readable memory 812, acquires and stores the signal data examples in the computer readable memory 812 upon receiving an input from a surface, keyboard surface 864, of the user interface 864 by a user.

The computer 811 can include a power source 854, depending upon the application the power source 854 may be optionally located outside of the computer 811. Linked through bus 856 can be a user input interface 857 adapted to connect to a display device 848, wherein the display device 848 can include a computer monitor, camera, television, projector, or mobile device, among others. A printer interface 859 can also be connected through bus 856 and adapted to connect to a printing device 832, wherein the printing device 832 can include a liquid inkjet printer, solid ink printer, large-scale commercial printer, thermal printer, UV printer, or dye-sublimation printer, among others. A network interface controller (NIC) 834 is adapted to connect through the bus 856 to a network 836, wherein time series data or other data, among other things, can be rendered on a third party display device, third party imaging device, and/or third party printing device outside of the computer 811.

Still referring to FIG. 8, the signal data or other data, among other things, can be transmitted over a communication channel of the network 836, and/or stored within the storage system 858 for storage and/or further processing. Contemplated is that the signal data could be initially stored in an external memory and later acquired by the processor to be processed or store the signal data in the processor's memory to be processed at some later time. The processor memory includes stored executable programs executable by the processor or a computer for performing the elevator systems/methods, elevator operation data, maintenance data and historical elevator data of the same type as the elevator and other data relating to the operation health management of the elevator or similar types of elevators as the elevator.

Further, the signal data or other data may be received wirelessly or hard wired from a receiver 846 (or external receiver 838) or transmitted via a transmitter 847 (or external transmitter 839) wirelessly or hard wired, the receiver 846 and transmitter 847 are both connected through the bus 856. The computer 811 may be connected via an input interface 808 to external sensing devices 844 and external input/output devices 841. For example, the external sensing devices 844 may include sensors gathering data before-during-after of the collected signal data of the elevator/conveying machine. For instance, environmental conditions approximate the machine or not approximate the elevator/conveying machine, i.e. temperature at or near elevator/conveying machine, temperature in building of location of elevator/conveying machine, temperature of outdoors exterior to the building of the elevator/conveying machine, video of elevator/conveying machine itself, video of areas approximate elevator/conveying machine, video of areas not approximate the elevator/conveying machine, other data related to aspects of the elevator/conveying machine. The computer 811 may be connected to other external computers 842. An output interface 809 may be used to output the processed data from the processor 840. It is noted that a user interface 849 in communication with the processor 840 and the non-transitory computer readable storage medium 812, acquires and stores the region data in the non-transitory computer readable storage medium 812 upon receiving an input from a surface 852 of the user interface 849 by a user.

The above-described embodiments of the present disclosure can be implemented in any of numerous ways. For example, the embodiments may be implemented using hardware, software or a combination thereof. When implemented in software, the software code can be executed on any suitable processor or collection of processors, whether provided in a single computer or distributed among multiple computers. Such processors may be implemented as integrated circuits, with one or more processors in an integrated circuit component. Though, a processor may be implemented using circuitry in any suitable format.

Also, the various methods or processes outlined herein may be coded as software that is executable on one or more processors that employ any one of a variety of operating systems or platforms. Additionally, such software may be written using any of a number of suitable programming languages and/or programming or scripting tools, and also may be compiled as executable machine language code or intermediate code that is executed on a framework or virtual machine. Typically, the functionality of the program modules may be combined or distributed as desired in various embodiments.

Also, the embodiments of the present disclosure may be embodied as a method, of which an example has been provided. The acts performed as part of the method may be ordered in any suitable way. Accordingly, embodiments may be constructed in which acts are performed in an order different than illustrated, which may include performing some acts concurrently, even though shown as sequential acts in illustrative embodiments. Further, use of ordinal terms such as first, second, in the claims to modify a claim element does not by itself connote any priority, precedence, or order of one claim element over another or the temporal order in which acts of a method are performed, but are used merely as labels to distinguish one claim element having a certain name from another element having a same name (but for use of the ordinal term) to distinguish the claim elements.

Although the present disclosure has been described with reference to certain preferred embodiments, it is to be understood that various other adaptations and modifications can be made within the spirit and scope of the present disclosure. Therefore, it is the aspect of the append claims to cover all such variations and modifications as come within the true spirit and scope of the present disclosure.

What is claimed is:

1. An elevator system, comprising:

an elevator car to move along a first direction;

a transmitter for transmitting a signal having a waveform;

a receiver for receiving the waveform, wherein the receiver and the transmitter are arranged such that motion of the elevator car effects the received waveform;

a processor having a computer readable memory is configured to represent the received waveform as a hybrid sinusoidal frequency modulated (FM)-polynomial phase signal (PPS) model having PPS phase parameters representing a speed of the elevator car along a first direction and a sinusoidal FM phase parameter representing a vibration of the elevator car along a second direction, and to solve the hybrid sinusoidal FM-PPS model to produce one or combination of the speed of the elevator car or the vibration of the elevator car; and a controller to control an operation of the elevator system using one or combination of the speed of the elevator car or the vibration of the elevator car, so as to assist in an operational health management of the elevator system.

2. The elevator system of claim 1, wherein the processor is configured for solving the hybrid sinusoidal FM-PPS model using a local approximation of a high-order phase function.

3. The elevator system of claim 2, wherein the local approximation of the high-order phase function is based on a Taylor series expansion of a sinusoidal function.

4. The elevator system of claim 2, wherein the local approximation of the high-order phase function is based on other power series expansions or linear approximations.

5. The elevator system of claim 1, wherein the processor solves the hybrid sinusoidal FM-PPS model using the PPS phase parameters and the sinusoidal FM phase parameter by:

compute a Local High-order Phase Function (LHPF), and extract peak locations;

estimate a sinusoidal FM frequency from the computed LHPF peak locations;

estimate the PPS phase parameters representing the speed of the elevator car along the first direction from the peak locations in the time-frequency rate domain of the received signal; and output one or combination of the speed of the elevator car and the vibration of the elevator car, to the controller to control the operation of the elevator system.

6. The elevator system of claim 1, wherein phase parameters of the reflected waveforms include a sinusoidal frequency modulated term and high-order polynomial phase terms, such that the high-order polynomial phase terms include kinetic parameters including time-varying acceleration, and the sinusoidal FM phase parameter represents the vibration of the elevator car along the second direction, such that the vibration is a lateral vibration along the second direction that is a lateral distance along the second direction between a vibration sensor of the sensors and a guiderail of the elevator system.

7. The elevator system of claim 1, wherein the hybrid sinusoidal FM-PPS model is utilized when a response time for outputting the PPS phase parameters is under a predetermine threshold time period, or when the sinusoidal FM phase parameter has a sinusoidal FM frequency that is less than a predetermine threshold sinusoidal FM frequency.

8. The elevator system of claim 7, further comprising:

a user input is provided on a surface of the at least one user input interface and received by the processor, wherein the user input relates to the predetermined threshold time period, the predetermined threshold sinusoidal FM frequency, or both, and process the user input to solve the hybrid sinusoidal FM-PPS model to produce one or combination of the speed of the elevator car and the vibration of the elevator car, to control the operation of the elevator system.

9. The elevator system of claim 1, wherein the receiver or the transmitter is attached to a shaft of the elevator system, or a transceiver is arranged on the elevator car, such that the reflection of the waveform from the shaft is sensed, such that the transmitted waveform is different from the received waveform due to the motion of the elevator car.

10. The elevator system of claim 1, wherein the elevator car moves in a dynamic motion in the first direction and measurements of speed are estimated as a PPS with the PPS phase parameters is associated to kinematic parameters of the elevator car, such that an initial velocity and acceleration of the elevator car are proportional to the PPS phase parameters.

11. The elevator system of claim 1, wherein the sinusoidal FM phase parameter represents vibration of the elevator car along the second direction, such that the vibration is due to one or a combination of deformation of guide rails of the elevator system, a configuration geometry of the guide-rails reflecting surface, aerodynamic forces of the elevator car, a lateral vibration of the elevator car due to mechanical causes or an uneven passenger load within the elevator car.

12. The elevator system of claim 1, wherein the stored produced vibration of the elevator car is compared with previously stored historical vibration data of the elevator car, to determine if the stored produced vibration of the elevator car is above a predetermine historical vibration threshold of the elevator car, so as to indicate an abnormal operational of the elevator car and to assist in operational health management of the elevator car.

13. A conveying machine method, comprising:

acquiring measurements generated from sensors in communication with the conveying machine over a period of time, to obtain a transmitted signal having a waveform, wherein the sensors are arranged such that motion of the conveying machine effects the transmitted signal resulting in an effected received waveform, and wherein the conveying machine includes one of an elevator, a turbine of a conveying transport machine or a helicopter;

using a processor having a computer readable memory configured to represent the received waveform as a hybrid sinusoidal frequency modulated (FM)-polynomial phase signal (PPS) model having PPS phase parameters representing a speed of the conveying machine along a first direction and a sinusoidal FM phase parameter representing a vibration of the conveying machine along a second direction, and to solve the hybrid sinusoidal FM-PPS model to produce one or combination of the speed of the conveying machine and the vibration of the conveying machine, that is stored in the computer readable memory; and controlling via a controller an operation of the conveying machine using one or combination of the speed of the conveying machine and the vibration of the conveying machine, so as to assist in an operational health management of the conveying machine or assist in initiating a safety action via controlling the operation of the conveying machine, to protect contents conveyed by the conveying machine.

14. The conveying machine method of claim 13, wherein the conveying machine is an elevator car of the elevator, and the hybrid sinusoidal FM-PPS model is used to estimate the PPS phase parameters representing the sensed speed of the elevator car along the first direction; and updating the speed of the elevator car based on the estimated first parameter.

15. The conveying machine method of claim 13, wherein the processor is configured for solving the hybrid sinusoidal FM-PPS using a local approximation of a high-order phase function, such that the local approximation of the high-order phase function is based on a Taylor series expansion of a sinusoidal function.

16. The conveying machine method of claim 13, wherein the processor solves the hybrid sinusoidal FM-PPS model using the PPS phase parameters and the sinusoidal FM phase parameter by:

computing a Local High-order Phase Function (LHPF), and extracting peak locations;

estimating a sinusoidal FM frequency from the computed LHPF peak locations;

estimating the PPS phase parameters representing the speed of the conveying machine along the first direction from the peak locations in the time-frequency rate domain of the received signal; and outputting one or combination of the speed of the conveying machine and the vibration of the conveying machine, to the controller to control the operation of the conveying machine.

17. The conveying machine method of claim 13, wherein the hybrid sinusoidal FM-PPS model is utilized when a response time for outputting the PPS phase parameters is under a predetermine threshold time period, or when the sinusoidal FM phase parameter has a sinusoidal FM frequency that is less than a predetermine threshold sinusoidal FM frequency.

18. A non-transitory computer readable storage medium embodied thereon a program executable by a computer for performing an elevator method, the elevator method comprising:

obtaining signal data generated from sensors relating to speed of a movement of an elevator car of the elevator in a first direction and storing the signal data in the non-transitory computer readable storage medium, wherein an estimated speed of the movement of the elevator car in the first direction is estimated using a signal propagated along a second direction, and wherein the first direction is different from the second direction;

formulating, by a processor, the speed estimation of the movement of the elevator car as a hybrid sinusoidal frequency modulated (FM)-polynomial phase signal (PPS) model having PPS phase parameters representing the sensed speed of the elevator car along the first direction and a sinusoidal FM phase parameter representing vibration of the elevator car along the second direction, and solving the hybrid sinusoidal FM-PPS model to update the speed of the elevator car; and controlling an operation of the elevator car via a controller using one or combination of the speed of the elevator car and the vibration of the elevator car, so as to assist in an operational health management of the conveying machine or assist in initiating a safety action via controlling the operation of the conveying machine, to protect contents conveyed by the conveying machine.

19. The elevator method of claim 18, further comprising:

solving the hybrid sinusoidal FM-PPS to estimate the PPS phase parameters representing the sensed speed of the elevator car along the first direction; and updating the speed of the elevator car based on the estimated first parameter.

20. The elevator method of claim 18, wherein the processor solves the hybrid sinusoidal FM-PPS model using a local approximation of a high-order phase function by:

computing a Local High-order Phase Function (LHPF), and extracting peak locations;

estimating a sinusoidal FM frequency from the computed LHPF peak locations;

estimating the PPS phase parameters representing the speed of the conveying machine along the first direction from the peak locations in the time-frequency rate domain of the received signal; and outputting one or combination of the speed of the conveying machine and the vibration of the conveying machine, to the controller to control the operation of the conveying machine.

* * * * *